United States Patent [19]

Fukuda et al.

[11] 4,272,334

[45] Jun. 9, 1981

[54] METHOD OF FLUIDIFICATION OF LIQUID BETWEEN PLANE PARALLEL PLATES BY JETTING THE LIQUID

[75] Inventors: Shuzo Fukuda, Yokohama; Tsutomu Watanabe, Yokosuka; Masahiro Abe, Yokohama, all of Japan

[73] Assignee: Nippon Kokan Kabushiki Kaisha, Tokyo, Japan

[21] Appl. No.: 109,078

[22] Filed: Jan. 2, 1980

[30] Foreign Application Priority Data

Jan. 12, 1979 [JP] Japan ..... 54-1261

[51] Int. Cl.[3] ..... C25D 5/08; C25D 7/06; C25D 21/10

[52] U.S. Cl. ..... 204/27; 204/28; 204/206; 204/273; 204/275

[58] Field of Search ..... 204/23, 22, 273, 275, 204/27, 28, 206

[56] References Cited

U.S. PATENT DOCUMENTS

| | | | |
|---|---|---|---|
| 3,558,455 | 1/1971 | Sorensen | 204/275 |
| 3,558,466 | 1/1971 | Lebrizzi | 204/275 |
| 3,875,041 | 4/1975 | Harvey | 204/273 |
| 4,053,377 | 10/1977 | Schlain | 204/275 |

*Primary Examiner*—T. M. Tufariello

*Attorney, Agent, or Firm*—Oblon, Fisher, Spivak, McClelland & Maier

[57] ABSTRACT

In an electrolytic treating on a strip of metal, namely electroplating, electrolytic degreasing or any other electrolytic treatment on a strip of metal, in order to fludify the liquid between the plane parallel plate electrodes immersed inside the tank or between the plane parallel electrodes and the metal strip passed therebetween by jetting the liquid from the nozzles into the tank, a plane dummy plate or plates are arranged between the nozzles and the plane parallel plate electrodes to adjoin the electrodes and extend in the direction of the nozzles in the same planes as the electrodes to thereby prevent the damping of the jet flow velocity. Moreover, the plane parallel plate electrodes have their edges on the nozzle side arranged in positions at which the half-value width of the nozzle jets from the nozzles overlap each other to thereby ensure a uniform distribution of the jet flow velocity.

7 Claims, 9 Drawing Figures

METHOD OF FLUIDIFICATION OF LIQUID BETWEEN PLANE PARALLEL PLATES BY JETTING THE LIQUID

DETAILED EXPLANATION OF INVENTION

The present invention relates to methods in which jets of liquid are introduced between the plane parallel plates immersed in the liquid contained in a tank so as to fluidify the liquid between the plane parallel plates. More particularly, the invention relates to a method of fluidifying the liquid whereby the liquid between the plane parallel plate electrodes immersed in the liquid contained in an electrolytic treating tank for performing electroplating, electrolytic degreasing or any other electrolytic treatment or where the liquid between the parallel plate electrodes and a strip of metal is fluidified, namely the liquid is made to flow in a predetermined direction so as to increase the treating efficiency of the solution.

A method of horizontally applying jets of fluid between a strip material and the electrodes of a horizontal pass type electro-galvanizing line may be cited as an example of the prior art techniques of directing jets of liquid between the plane parallel plates so as to utilize the effect of the flow of the fluid between the plane parallel plates. A plating tank utilizing such a horizontal jet emission method is disclosed in Japanese Patent Application Publication No. 45-7842. An example of such plating tanks is shown in FIGS. 1 and 2. FIG. 1 is a plan view of the plating tank and FIG. 2 is a sectional view taken along the line II—II of FIG. 1. In the Figures, numeral 1 designates the plating tank. Contained in the plating tank 1 is a plating solution 6 usually consisting of a solution of zinc sulfate or zinc chloride or a mixture of the two. Arranged in the plating tank 1 are upper electrodes 4 and lower electrodes 5 which extend parallel to each other with their electrode surfaces being immersed in the plating solution 6. A metal strip 3 to be electroplated is placed in the plating tank 1 to extend through a plating solution sealing dam roll 7 at each of the opposite side walls. The electrodes 4 and 5 used usually consist of metallic zinc in bar or plate form each having for example a length of 700 mm, thickness of 50 mm and a height of 100 mm and they are arranged in the crosswise direction of the strip 3 as shown in the illustration. For instance, if the strip width is 1200 mm, a total of 1200/50=24 upper and lower electrodes 4 and 5, respectively, are arranged in a manner that the strip edges substantially align with the electrode edges and the number of electrodes to be arranged is varied for plating strip materials of different widths.

In order to apply jets of fluid to the plane parallel plate electrodes 4 and 5 in the plating tank 1 and thereby to fluidify the plating solution, a plurality of nozzles 2 are arranged on one side wall of the plating tank 1 so as to be directed to the space between the upper electrodes 4 and the strip 3 and the space between the strip 3 and the lower electrodes 5. The current density increases with increase in the flow velocity of jets between the electrodes 4 and 5 and the strip 3 and the plating rate also increases with increase in the jet flow velocity. Also, from the standpoint of plating efficiency, the distribution of flow velocity between the electrodes and the strip should desirably be as uniform as possible and the occurrence of any local high velocity area or low velocity area is not desirable.

With the knowm methods, however, even if the flow velocity at the nozzle outlet is high, the flow velocity of jet will be damped greatly at the strip edge on the side remote from the nozzle and moreover due to the large spacing between the arranged nozzles, a low velocity area tends to occur between the adjacent nozzles at the strip edge on the nozzle side.

The experiments conducted by the inventors have shown that practically the spray angle of a jet is not dependent on the nozzle diameter but it increases in proportion to the distance from the nozzle. As a result, in order to prevent the occurrence of a low velocity area at the strip edge on the nozzle side, the distance between the nozzle and the strip edge (designated at L in FIG. 2) must be suitably selected in accordance with the spacing between the nozzles.

The flow velocity of a jet will be diminshed by the entrainment of the ambient fluid by the jet and the diminution of flow velocity of a free jet differs in diminution rate from that of the jet between plane parallel plates. The diminution rate of the former is greater than the latter.

In the case of a known horizontal jet emission method, the distance L between the nozzle and the strip edge is in the range of 200 to 500 mm even in the case of a strip of the maximum width and the distance L increases with decrease in the strip width. The jet takes the form of a free jet in the space between the nozzle and the strip edge and the distance L is an important cause of decrease in the jet velocity. FIG. 3 shows the results of experimental studies made on the diminution of flow velocity at the jet central axis by varying the distance L between the nozzles and the strip edge but not varying the nozzle diameter and the distance between the planar parallel plates. In the Figure, the abscissa represents the values of X/D (where X is the distance from the nozzle and D is the nozzle diameter) and the ordinate represents the values of $U_m/U_o$ (where $U_m$ is the flow velocity at the jet central axis and $U_o$ is the nozzle output jet velocity). Also in the Figure, the solid line ① presents the case of a free jet, the dotted line ② the case where L=70 mm, the one-dot chain line ③ the case where L=275 mm, and the two-dot chain line ④ the case where L=480 mm. It will be seen from the Figure that an increase in the distance L results in an increase in the free jet area and the jet flow velocity is also diminished greatly.

In the case of the known method with the nozzle to strip edge distance L=275 mm and the strip width of 1500 mm, the jet velocity at the strip edge on the nozzle side will be reduced to 22% of the nozzle outlet jet velocity and the jet velocity at the strip edge remote from the nozzles will be diminished to 6% of the nozzle outlet jet velocity.

While increased pump capacity, bringing the nozzle position closer to the strip edge, etc., may be considered as possible countermeasures to overcome the foregoing deficiencies, these measures also have the following problems. More specifically, in the case of the former measure, a high pressure pump of as high as several tens $Kg/Cm^2$ and capable of providing a large flow rate must be used if the desired jet velocity is to be obtained with the known method as such and the equipment cost as well as the operating cost will also be increased. In the case of the latter measure, the equipment must be converted so that the position of nozzles can be changed in accordance with the width of a strip and this is not practical since it is detrimental to the desired simplicity of the production equipment. On the other hand, if the nozzles are positioned excessively close to the strip, some localized low velocity areas will be caused at the strip edge on the nozzle side. To prevent this, the nozzle spacing must be reduced, with the result that the number of nozzles must be increased very greatly and jets of unnecessarily large flow rate must be emitted.

It will thus been seen from the foregoing that the known methods are disadvantageous in that when jets of liquid are directed from nozzles toward the spaces between the plane parallel plates immersed in the solution contained in a tank, if the distance between the nozzles and the plane parallel plates is long, the flow velocity of jets will be diminished considerably, whereas if the distance is short local low flow velocity areas will be produced between the plane parallel plates making the flow velocity distribution nonuniform between the plates.

It is therefore an object of the invention to provide, in a method of fluidifying the solution between the plate parallel plates immersed in the solution of a tank by means of the jets directed from nozzles toward between the plane parallel plates, a reduction in the diminution of jet velocity while maintaining a uniform flow velocity distribution of the jets.

It is another object of the invention to provide a method of fluidifying the solution between plane parallel plates, which requires no substantial reconstruction of the apparatus for performing the known method of fluidifying the solution between plane parallel plates by means of jets of liquid, which can be performed by means of simple operations and which can greatly improve the efficiency of jets in fluidifying the solution between plane parallel plates.

In accordance with the invention there is thus provided a method of fluidifying the solution between plane parallel plates by means of jets of liquid, wherein jets of liquid are directed from nozzles toward and between the plane parallel plates immersed in the solution contained in a tank so as to fluidify the solution between the parallel plates. The method is characterized in that the nozzles for emitting jets are each arranged at such a distance from the plane parallel plates that the half-value width of jets (here, the half-value width is defined as the width of that jet portion whose flow velocity is greater than one half of the flow velocity at the jet central axis) overlap each other at the plane parallel plate edges on the nozzle side so as to make uniform the flow velocity of the solution between the plane parallel plates, and that a plane dummy plate or plates are disposed between the nozzles and the plane parallel plates to adjoin the parallel plates and extend toward the nozzles in the same planes as the parallel plates, thereby to reduce the dimunition of the flow velocity of the jets.

The above and other objects, features and advantages of the invention will become apparent from the following detailed description taken in conjunction with the accompanying drawings, in which.

Figure 4:
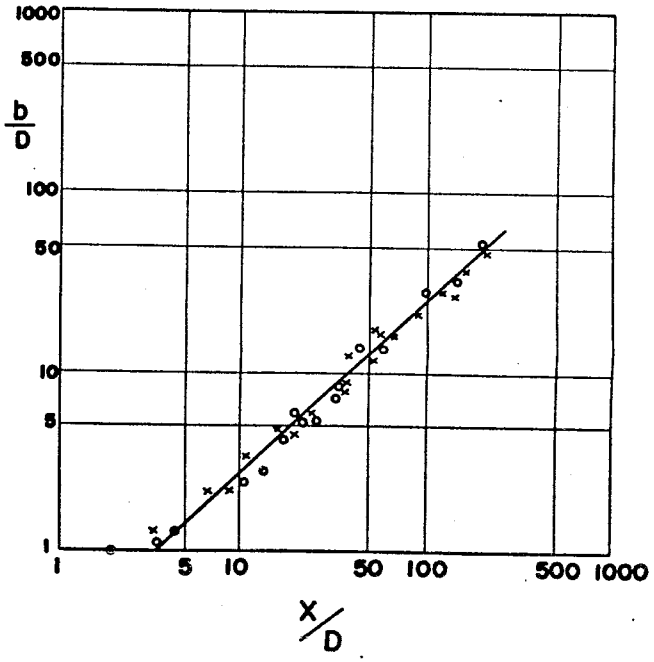
FIG. 4 is a graph showing the relationship between the spray angle of jets and the distance from the nozzles.

In accordance with the method of this invention, a plurality of nozzles are first arranged at a distance from plane parallel plates so that the half-value width of jets of liquid overlap each other at the plane parallel plate edges on the nozzle side so as to make uniform the flow velocity distribution of the solution between the plane parallel plates. More specifically, the distance between the nozzles and the plane parallel plates and the spacing between the nozzles are determined in accordance with the spray angle of the jets. FIG. 4 shows the results of the investigations made by the inventors on the spray angle of the free jets and the jets between the plane parallel plates produced by means of circular nozzles. The spray angle of a jet is represented by the width of that jet portion whose flow velocity at the jet central axis is greater than ½ of the flow velocity (half - value width).

In FIG. 4, the abscissa represents the values of X/D (where X is the distance from the nozzle and D is the nozzle diameter) and the ordinate represents the values of b/D (where b is the half-value width and D is the nozzle diameter). Also in the Figure, the marks of O and X respectively indicate the measured values of free jets and jets between the plane parallel plates. The half-value width b does not practically vary depending on the free jet and the jet between the plane parallel plates, nor the width varies in dependence upon the nozzle diameter D, and the width increases in proportion to the distance X from the nozzles.

The half-value with b can be represented by the following empirical formula.

$$b=0.25\,X$$

Figure 5:
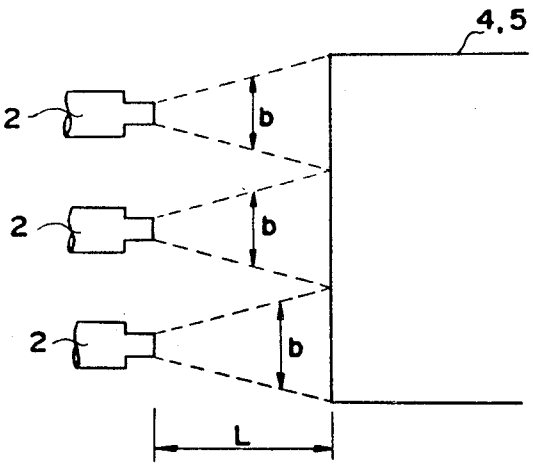
FIG. 5 is a schematic plan view showing one form of an arrangement for performing a method according to the invention.

An experimental study of the flow velocity at the plane parallel plate edges on the nozzle side was conducted by way of example by using circular nozzles 2 and arranging so that the half-value width b of the jets from the nozzles 2 overlapped each other at the nozzle side edges of plane parallel plates 4 and 5 as shown in FIG. 5 and the study resulted in (maximum flow velocity) / (minimum flow velocity)$\approx$2 showing that there was a fairly uniform flow velocity distribution. Thus, in accordance with the method of the invention, firstly the nozzles 2 are arranged in such a manner that the half-value width of the jets from the nozzles 2 overlap each other at the plane parallel plate edges on the nozzle side. If the nozzle spacing is 100 mm, the half-value width b is given by $b=0.25X$ and consequently it should be selected so that $X \geqq 400$ mm.

In accordance with the method of the invention, secondly, with a view to reducing the dimunition of flow velocity, a plane dummy plate is placed between the nozzles and each of the plane parallel plates so as to adjoin the plane parallel plate and extend toward the nozzles in the same plane as the plane parallel plate.

As mentioned previously, the nozzles must be arranged at a certain distance from the plane parallel plates so as to make uniform the flow velocity distribution of the solution between the plane parallel plates. In addition, the distance between the nozzles and the plane parallel plates must be increased with an increase in the nozzle spacing. On the other hand, due to the previously mentioned disadvantages from the equipment and operation points of view, naturally there is a certain limit to the decrease in the nozzle spacing or the increase in the number of the nozzles used. As a result, the distance between the nozzles and the plane parallel plates must in fact be selected about 400 mm. Consequently, if the free jet area between the nozzles and the plane parallel plates is as large as 400 mm with the resulting large dimunition of flow velocity in this area and if circular nozzles of 16.5 mm in inner diameter are used, the jet flow velocity at the plane parallel plate edges on the nozzle side will be diminished to as low as about 14% of the nozzle outlet flow velocity.

Figure 6:
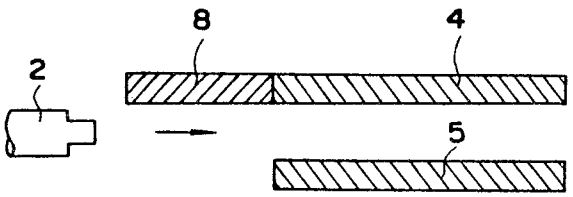
FIG. 6 is a schematic sectional view showing another form of the arrangement for performing the method of the invention.
Figure 7:
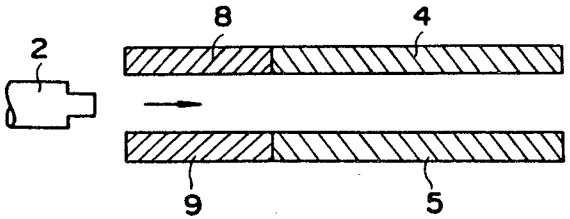
FIG. 7 is a schematic sectional view showing still another form of the arrangement for performing the method of the invention.

Thus, in accordance with the method of the invention, as shown in FIGS. 6 and 7, a plane dummy plate 8 or plates 8 and 9 are arranged between the nozzles 2 and the plane parallel plates 4 and 5 so as to adjoin the plane parallel plates 4 or the plane parallel plates 4 and 5 and extend toward the nozzles 2 in the same plane as the plane plate 4 or the plane plates 4 and 5. If the distance between the nozzles 2 and the plane parallel plates 4 and 5 is not so large, it is suffice to control the jets on one side by providing the plane dummy plate 8 only on one side as shown in FIG. 6. However, in the event that the distance between the nozzles 2 and the plane parallel plates 4 and 5 is increased, a greater effect will be obtained by providing the plane dummy plates 8 and 9 on both sides as shown in FIG. 7 so as to control the jets on both sides.

Figure 3:
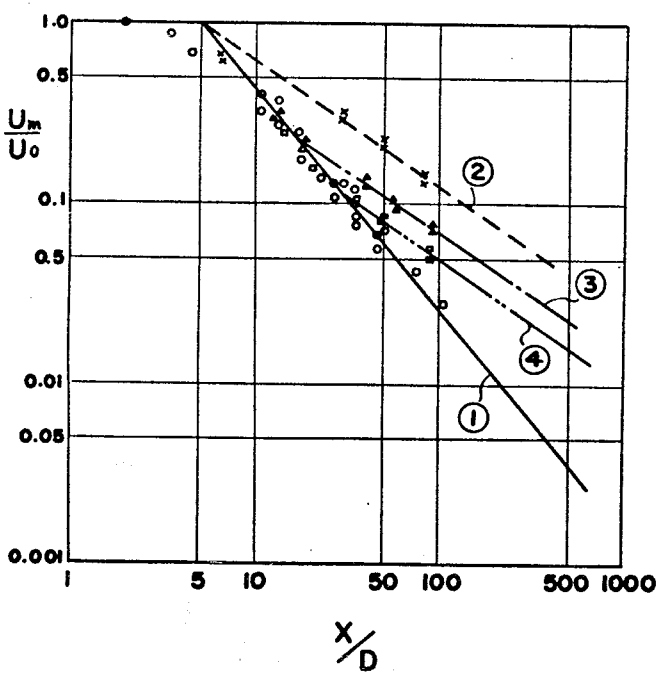
FIG. 3 is a graph showing the relationship between the jet flow velocity and the distance from the nozzles in the horizontal jet emission method.

In this case, as will be seen from FIG. 3, it should be arranged so that the distance between the forward ends of the dummy plates and the nozzles is given by $X'/D=5$. In other words, it will be deduced from FIG. 3 that the maximum effect can be produced by positioning the forward end of the dummy plates at such a distance resulting in $X'=5\cdot D$, and also it is in fact well known in the field of hydromechanics that the distance of O to 5D from the nozzle forward end constitutes a so-called potential core which is an area where no dimunition of flow velocity takes place. As a result, where nozzles of $D=16.5$ mm are used, it is desirable to use a plane dummy plate or plates which cover the area extending from the position of $5D=82.5$ mm to the nozzle side edges of the plane parallel plates.

Figure 8:
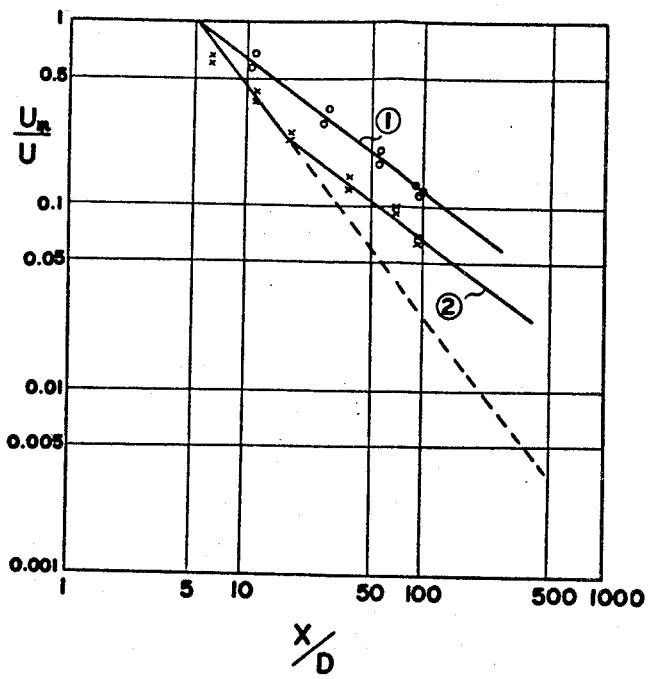
FIG. 8 is a graph showing the relationship between the jet flow velocity and the distance from the nozzles in the method of the invention.

FIG. 8 shows the results of the experimental investigations on the effect in the case where the distance between the nozzles and the plane parallel plates was 400 mm, the distance between the plane parallel plates was 15 mm and the nozzles used were of the circular type having an inner diameter of 16.5 mm and where the plane dummy plate 8 of 320 mm wide was provided along the plane parallel plate 4 as shown in FIG. 6. The symbols on the co-ordinates are the same as in FIG. 3. The results of the measurement at the points marked O and the line ① connecting the points correspond to the case with the plane dummy plates and the results of the measurement at the points marked X and the line ② connecting these points correspond to the prior art method without any plane dummy plate. The dotted line is a virtual line in the case of free jets. As will be seen from FIG. 8, in accordance with the method of the invention employing plane dummy plates, the provision of a dummy plate for only one of the plane parallel plates had the effect of improving the dimunition of the jet velocity at the nozzle side edge of the plane parallel plates only to 33% of the nozzle outlet flow velocity as compared with the case of the prior art method where the same jet velocity was reduced to 15% of the nozzle outlet flow velocity. This effect is the same for the case where the center position of the nozzles are aligned with the center of the distance between the plane parallel plates and the case where the nozzle center position is in alignment with the surface of one of the plane parallel plates.

It will thus be seen from the foregoing that in accordance with the invention, by providing with the plane dummy plate or plates the jets are converted from the state of free jets having a large dimunition rate to the state of controlled jets having a reduced dimunition rate, which results in reducing the diminution of the jet velocity in the distance or space between the nozzles and the plane parallel plates. Moreover, by virtue of the fact that the distance between the nozzles and the plane parallel plate is selected so that the half-value width of the jets from the adjacent nozzles overlap each other at the nozzle side edges of the plane parallel plates, the number of the nozzles is reduced and the flow velocity distribution between the plate includes no local low velocity area. In other words, by virtue of the plane dummy plates, there no longer exists any substantial free jet area between the nozzles and the plane parallel plates and the occurrence of any local low velocity area is also prevented. In this way, the method of this invention can be considered as one which is based on ingenious utilization of the inherent nature of jets of liquid.

Figure 1:
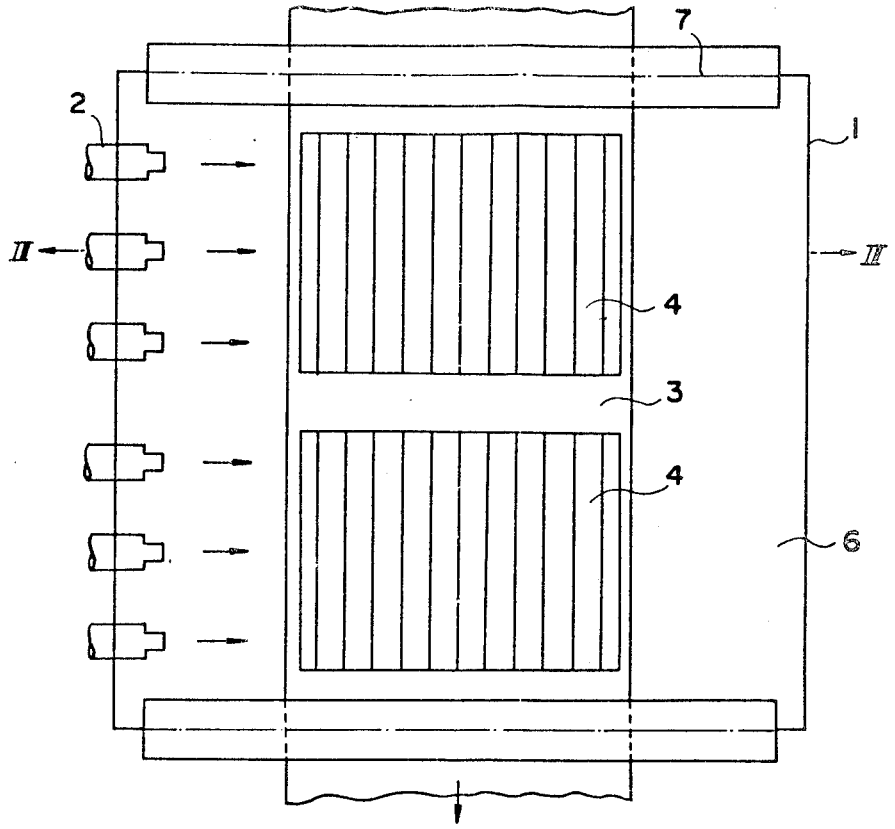
FIG. 1 PRIOR ART
FIG. 1 is a plan view of an electrogalvanizing tank utilizing a known horizontal jet emission method.
Figure 2:
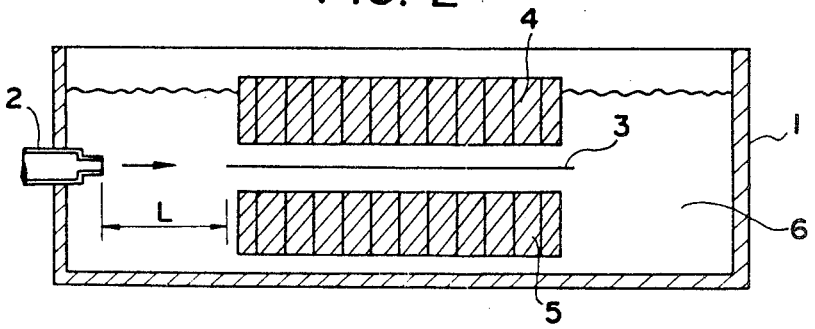
FIG. 2 PRIOR ART
FIG. 2 is a sectional view taken along the line II—II of FIG. 1.
Figure 9:
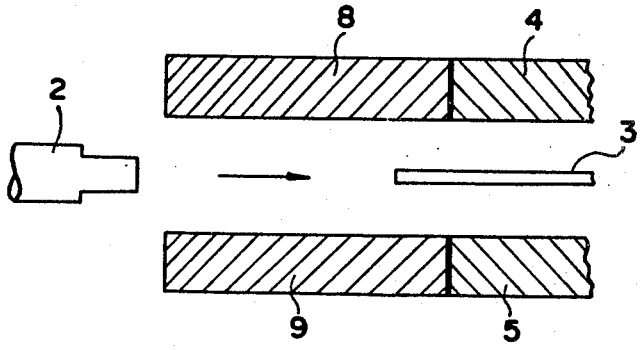
FIG. 9 is a partial schematic sectional view of an electrogalvanizing tank incorporating the method of the invention.

One of the practical applications of the method of this invention will be the electrogalvanizing process for a strip steel electrogalvanizing line. FIG. 9 is a partial sectional view of an apparatus for performing the electrogalvanizing process. The apparatus of FIG. 9 practically corresponds to the apparatus of FIG. 2 which is added with the plane dummy plates of the invention. Nozzles 2 are arranged between a pair of plane parallel plates respectively comprising upper electrodes 4 and lower electrodes 5 so as to extend parallel therewith and each of the nozzles 2 has its central axis arranged in alignment with the surface of a strip 3. Also plane dummy plates 8 and 9 each made of a non-conductive material are provided so as to respectively adjoin the electrodes 4 and 5 and extend toward the nozzles 2 in the same planes as the electrodes 4 and 5. Where the distance between the nozzles 2 and the edge of the strip 3 is not so large, one of the dummy plates may be eliminated.

If the method of the invention is employed for the manufacture of electrogalvanized strip steel, the method can be used efficiently with the procedures well suited to the field and practical application and there will be no difficulty from the operation point of view as will be described hereunder.

In other words, each of the dummy plates may comprise a plurality of plate members of the same shape with the electrodes so as to be mounted on the same support with the electrodes, and if the number of the electrodes is varied to meet a change in the strip width, it is only necessary to vary the number of the dummy plate members. For example, where strip materials of some known widths are to be produced, it is possible to preliminarily prepare some different types of unitary plane dummy plates in correspondence with different distances between the nozzles and the strip edge for the different strip widths so that when the strip width is changed with the resulting adjustment of the number of electrodes, the dummy plate may be changed correspondingly.

In accordance with the prior art method, when the strip width is changed, the free jet area between the nozzles and the strip edge is varied and the diminution rate of the jet velocity is also varied considerably, thus causing the jet velocity to be diminished increasingly with a decrease in the strip width. In accordance with the method of the invention, however, a change in the strip width does not change the diminution of jet velocity, and in the case of small strip widths a jet velocity of 2 to 4 times that of the prior art method can be obtained. Thus, by increasing the flow velocity in the space between the electrodes and the strip, it is possible to greatly increase the available current density. In the past, the use of a current density higher than 70 A/dm$^2$ resulted in the electrodeposition of black power substance on the plated surface, greatly deteriorating the appearance of the product. In accordance with the method of this invention, it is possible to use a high current density of over 150 A/dm$^2$ and the production speed can be increased more than two times.

The method of the invention will now be described by way of example with reference to the electrogalvanizing in a steel strip electrogalvanizing line.

The electrogalvanizing was accomplished by using different current densities with the following conditions and the results obtained are shown in Table 1.

(1) Strip: Width = 915 mm
Plate thickness = 2.3 – 0.2 mm
travel speed = 40 m/min
(2) Plating bath composition:

| | |
|---|---|
| $ZnSO_4 \cdot 7H_2O$ | 400 g/l |
| $ZnCl_2$ | 150 g/l |
| $NH_4Cl$ | 30 g/l |
| temperature | 50° C. |

(3) Electrodes: width (strip width direction length) = 900 mm
length (line direction length) = 800 mm
(4) Nozzles: header pressure = 2.5 kg/cm$^2$
nozzle diameter = 16.5 mm
spacing (nozzle pitch) = 80.0 mm
number of nozzles (per tray) = $2(\frac{800}{80}) = 20$
(5) Distance between nozzle end and strip edge = 320 mm
(6) Plane dummy plate = 5 plate members of 50 mm wide (total width of 250 mm in strip width direction)
(7) Distance between nozzle end and dummy plate = 320 – 250 = 70 mm

TABLE 1

| Current density | Electrodeposition of black powder substance |
|---|---|
| 140 A/dm$^2$ | none |
| 150 " | none |
| 160 " | deposited only partly |
| 200 " | deposited |

Table 2 shows the results obtained by performing the electrogalvanizing using the same conditions as mentioned before except that the plane dummy plates were eliminated.

TABLE 2

| Current density | Electrodeposition of black powder substance |
|---|---|
| 70 A/dm$^2$ | none |
| 80 " | deposited only partly |
| 100 " | deposited |

As will be seen from Tables 1 and 2, in accordance with the method of this invention it is possible to use a high current density of 150 A/dm$^2$, whereas without any plane dummy plate it is possible to use only current densities less than 70 A/dm$^2$.

As a result, in accordance with the method of the invention it is possible to manufacture, for the same line speed, products of thicker coating of zinc without any increase in the equipment (e.g., without increase in the number of plating tanks) and similarly the products of the same coating weight of zinc can be produced with an equipment of a shorter line length. In other words, if it is desired to manufacture products of the same coating weight of zinc with the same number of plating tanks, the use of the method of this invention ensures the manufacture of products at a higher line speed. Since this available line speed is substantially proportional to the current density, the described embodiment ensures a productivity of as high as more than two times and this fact proves the utility of the method according to the invention.

While the present invention has been described in detail as mainly applied to the electrogalvanizing of steel strip in an electrogalvanizing line, the method of the invention is of course not limited to the described embodiment and the method can be equally put in any other electrolytic treatments, such as electrolytic degreasing where jets of liquid are introduced between the plane parallel plates immersed in the solution contained in a treating tank so as to increase the efficiency of treatment by the solution by utilizing the forced convection caused by the jets.

We claim:

1. A method wherein a pair of plane parallel plates each formed by at least one electrode are arranged one above another in a spaced parallely opposing relation within an electrolytic treating tank filled with an electrolyte and having a plurality of nozzles laterally arranged on one side of said tank, a strip of metal to be subjected to an electrolytic treatment is passed between said pair of plane parallel plates, and said electrolyte between said plane parallel plates is fluidified by jets of liquid from said nozzles, wherein said nozzles are arranged at predetermined spaces such that a half-value width of jets from the respective adjacent ones of said nozzles overlap each other at one edge of said plane parallel plates on the side of said nozzles to thereby make uniform the flow velocity of said electrolyte between said plane parallel plates, and wherein at least one plane dummy plate is disposed between said nozzles and at least one of said plane parallel plates such that said at least one dummy plate adjoins one end of said one of said plane parallel plates and extends toward said nozzles entirely in the same plane with said one plane parallel plate to thereby reduce the diminution of the flow velocity of said jets.

2. A method as set forth in claim 1, wherein said plane dummy plate is arranged at a position given by the following equation $$X = 5 \cdot D$$

where X' is the distance between tips of said nozzles and a nozzle side end of said plane dummy plate, and D is the diameter of said nozzles.

3. A method as set forth in claim 1, wherein said plane dummy plate or plates are disposed between said nozzles and only one of said plane parallel plates.

4. A method as set forth in claim 1, wherein said plane dummy plate is formed into substantially the same shape with said plane parallel plate so as to be fixed to the same support for said plane parallel plate.

5. A method as set forth in claim 1, wherein each of said plane parallel plates comprises a plurality of electrodes, and wherein said plane dummy plate comprises a plurality of plate members of substantially the same shape with said electrodes, whereby the number of said plate members is varied in accordance with the number of said electrodes used.

6. A method as set forth in claim 1, wherein said nozzles are kept at a distance L from one edge of said plane parallel plates and wherein said nozzles are arranged to produce said jets of which a half value width b is satisfied with the following relation:

$$L = \frac{b}{0.25}.$$

7. A method as set forth in claim 6, wherein said nozzles are arranged in such a manner that they have a pitch lower than 0.25L with each other and thereby said half-value width of the jet is made overlapped at one edge of said plane parallel plates.

* * * * *